US007958860B2

(12) United States Patent
Bindel et al.

(10) Patent No.: US 7,958,860 B2
(45) **Date of Patent: *Jun. 14, 2011**

(54) CRANKCASE, OIL CHANNEL MOLD CORE FOR PRODUCING A CRANKCASE AND PROCESS FOR PRODUCING A CRANKCASE

(75) Inventors: Uwe Bindel, Weinstadt (DE); Werner Hofheinz, Denkendorf (DE)

(73) Assignee: Daimler AG, Stuttgart (DE)

( * ) Notice: Subject to any disclaimer, the term of this patent is extended or adjusted under 35 U.S.C. 154(b) by 381 days.

This patent is subject to a terminal disclaimer.

(21) Appl. No.: 12/190,181

(22) Filed: Aug. 12, 2008

(65) Prior Publication Data

US 2008/0296092 A1 Dec. 4, 2008

Related U.S. Application Data

(63) Continuation of application No. 11/406,664, filed on Apr. 18, 2006, now Pat. No. 7,412,957.

(30) Foreign Application Priority Data

Apr. 18, 2005 (DE) ..... 10 2005 017 764
May 24, 2005 (DE) ..... 10 2005 023 902

(51) Int. Cl.
*F02B 75/00* (2006.01)
*F01M 11/02* (2006.01)
*B23P 25/00* (2006.01)

(52) U.S. Cl. ..... 123/195 R; 123/196 R; 29/527.5; 29/527.6

(58) Field of Classification Search ..... 123/195 R, 123/196 R; 184/6.5, 6.8, 6.9; 29/527.5, 29/527.6, 888.01, 572.05, 527.06
See application file for complete search history.

(56) References Cited

U.S. PATENT DOCUMENTS

| | | | |
|---|---|---|---|
| 2,739,574 | A | 3/1956 | Scheiterlein |
| 2,899,015 | A | 8/1959 | Leach et al. |
| 3,933,335 | A | 1/1976 | Maruyama |
| 3,945,429 | A | 3/1976 | Wahlqvist |
| 4,033,312 | A | 7/1977 | Howe |
| 4,702,204 | A | 10/1987 | Anno et al. |
| 4,907,551 | A | 3/1990 | Takashi et al. |
| 5,054,442 | A | 10/1991 | Pietsch et al. |
| 5,622,156 | A | 4/1997 | Rose et al. |
| 6,158,408 | A | 12/2000 | Hauder |

(Continued)

FOREIGN PATENT DOCUMENTS

DE 3914124 C2 11/1989

(Continued)

OTHER PUBLICATIONS

"SFSA: Overview of the Casting Process." Steel Founders' Society Of America. Jan. 21, 2001. Internet Archive. Jan. 21, 2007. <http://web.archive.org/web/20010121222100/http://www.sfsa.org/sfsa/sctintcp.html>.

(Continued)

*Primary Examiner* — Noah Kamen
(74) *Attorney, Agent, or Firm* — Patent Central LLC; Stephan A. Pendorf

(57) ABSTRACT

A crankcase of an internal combustion engine with at least one main lubricant channel for supplying the internal combustion engine with lubricant and with at least one oil return flow channel (10) for return guidance of the excess lubricant into a reservoir container (11), wherein the oil return flow channel (10) exhibits a peg-shaped widening (12), which is formed by the attachment a bearing support of an oil channel core (18). The invention further concerns an oil channel core.

12 Claims, 1 Drawing Sheet

U.S. PATENT DOCUMENTS

| | | | |
|---|---|---|---|
| 6,402,227 | B1 | 6/2002 | Riehle et al. |
| 6,571,763 | B1 | 6/2003 | Bakker |
| 2006/0144353 | A1 | 7/2006 | Kim |

FOREIGN PATENT DOCUMENTS

| | | | |
|---|---|---|---|
| DE | 3923986 | C1 | 1/1990 |
| DE | 19508967 | C2 | 9/1996 |
| DE | 29812739 | U1 | 9/1998 |
| DE | 19812464 | A1 | 10/1998 |
| DE | 19902242 | A1 | 8/2000 |
| DE | 20303276 | U1 | 5/2003 |

OTHER PUBLICATIONS

"Sand Casting Explained," Metal Technologies, Inc. Jan. 21, 2007. <http://www.metal-technologies.com/SandCasting.aspx>.

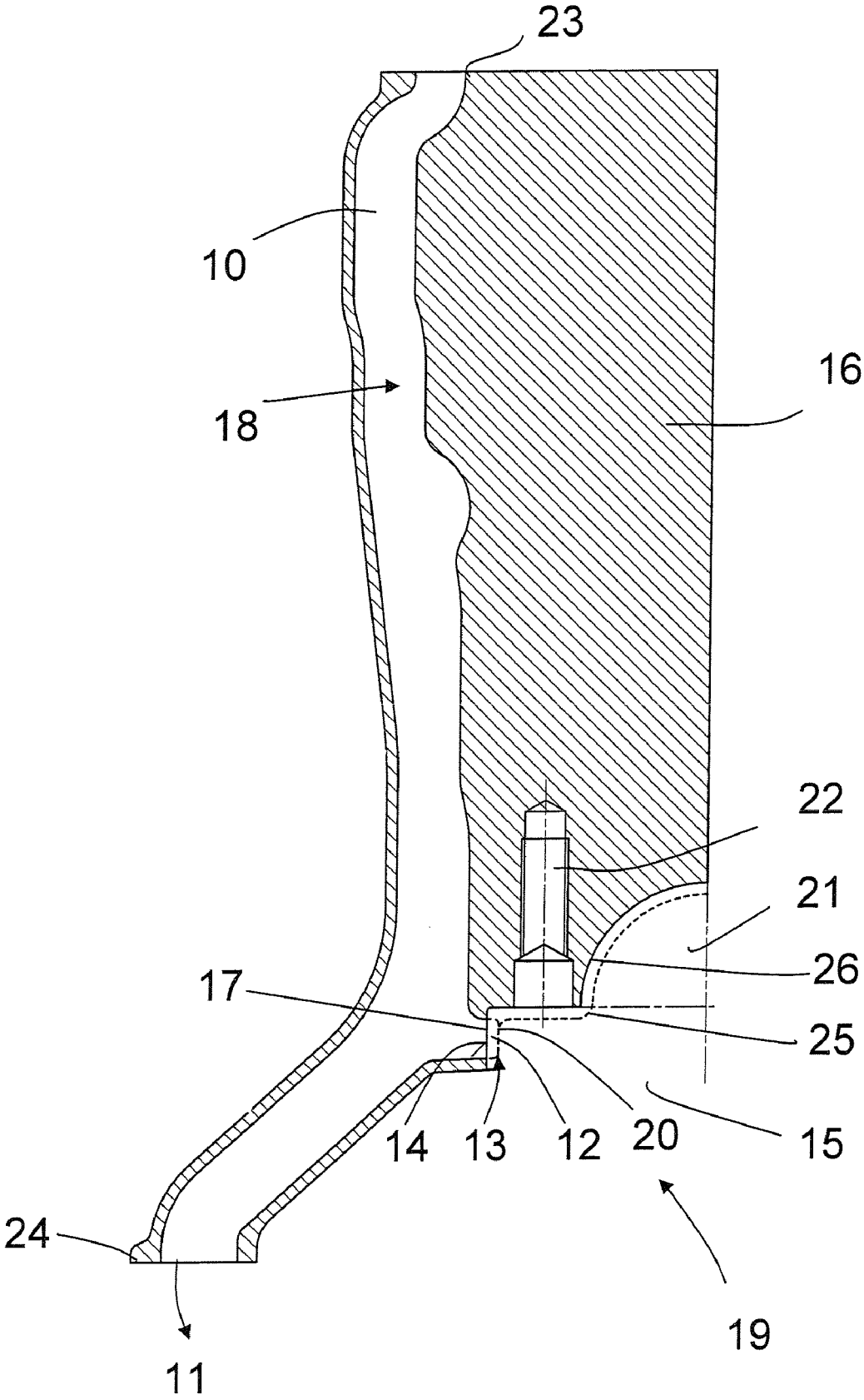
23
10
18
16
22
21
26
17
25
14
13
12
20
15
24
19
11

CRANKCASE, OIL CHANNEL MOLD CORE FOR PRODUCING A CRANKCASE AND PROCESS FOR PRODUCING A CRANKCASE

BACKGROUND OF THE INVENTION

1. Field of the Invention

The invention concerns a crankcase, an oil channel core for producing a crankcase, and a process for producing a crankcase according to the main claim and the dependent claims.

It is known to produce crankcases for internal combustion engines as cast parts in a sand casting or pressure casting process. Conventionally, oil channels such as oil return channels of a crankcase housing are shaped by a core withdrawal process using shaped parts or oil channel cores. For smoothing the surface of the thus produced work pieces, refractory dressings are used on the sand molds, which are applied onto the oil channel cores in order to flatten or smooth the porous surface of the oil channel cores. Conventionally, for this finely ground, thermally-stable to high-temperature fire-stable materials are employed as base material. The coating layer insulates the substrate and protects it from thermal stress due to the molten metal.

2. Description of the Related Art

In the German patent document DE 39 14 124 C2, oil channel cores are disclosed having for example a slat shape or peg-shape.

The problem therewith is that the oil return flow channels are elongate and have a narrow diameter relative to their longitudinal direction. If the oil channel core is supported, during a drying process following coating, for example during an oven treatment, on supports above and below the later produced cast part, the oil channel core bends, which can lead to a detrimental deformation of the oil return flow channel. Supporting or bearing the piece in the area between the above-mentioned support points is undesirable since the coating will become damaged at the bearing location, and during the later casting the casting material of the crankcase housing penetrates into the mold. It is a problem herein that this produces a defect that is difficult to purge.

In the utility models DE 29 812 739 U1 and DE 20 303 276 U1, specially shaped oil channel mold supports are proposed, in order to minimize the above-described problem. This type of support must however be produced separately, which necessary leads to an increase in the production costs.

SUMMARY OF THE INVENTION

The invention is concerned with the task of providing an improved oil channel mold or core as well as an advantageous crankcase housing. Besides this, a simplified process for producing a crankcase housing is to be provided, with which the above-described disadvantages can be avoided.

The task is inventively solved by the characteristics of the independent claims.

In the inventive crankcase housing the oil return flow channel has a plug- or peg-shaped (hereafter simply "peg-shaped") widening, which is formed by the attachment or fusion or the unitarily forming of the bearing support of the oil channel core. Preferably the bearing support is formed directly on the oil channel core, so that no further supports need be provided, whereby a reduction in the production cost can be achieved. Besides this, the oil channel core is supported in an advantageous area by the peg-shaped widening during the drying process following coating, so that a bending or sagging can be avoided.

Advantageous embodiments and advantages of the invention can be seen from the description as well as the remaining claims.

Preferably the peg-shaped widening is provided in an area of the cast part which is predetermined for a later intended surface treatment. Although this could result in a damaging of the coating layer, this however does not have the above-described disadvantageous effect, since the crankcase housing produced as cast part is later to be surface treated precisely in this area. In particular, it is intended, that the cast part is machined away in this area, in order to provide a sideways receptacle for a predetermined bearing lid or cover. The thus resulting opening can advantageously be covered completely or substantially by the subsequently produced bearing lid, so that the oil return channel continues to allow a forced direct return flow of excess lubricant from the cylinder head to a collecting reservoir. Preferably thus the peg-shaped widening is provided in the area of a side receptacle surface for a main bearing lid of a crankcase.

Multiple oil channels can be provided connected with each other, for example one oil channel per cylinder base, wherein each of the oil channels exhibits an inventive peg-shaped widening facing in the same direction. The corresponding oil channel core can then be self supporting via multiple peg-shaped widenings, for example, one peg-shaped widening per cylinder base or, as the case may be, bearing cradle. The crankcase may further include at least one of at least one water channel and at least one pressure oil channel having a peg-shaped widening.

In one inventive oil channel core a peg-shaped widening is provided, wherein the peg-shaped widening is provided in one of the areas predetermined for later surface treatment. Preferably the peg-shaped widening is integrally formed. The manufacture of a thus designed, integral oil channel core is simple and only marginally increases costs of the production. Preferably the peg-shaped widening is usable as bearing support in a oven treatment, in order to avoid a disadvantageous deformation of the oil channel core resulting for example from bending or sagging.

Preferably the peg-shaped widening is formed transverse to a main bearing direction of the oil channel core, whereby later an advantageous connecting surface with the piston space results.

In one inventive process for producing a crankcase housing of an internal combustion engine, the oil return channel is formed in a cast part, preferably in a cylinder base formed as a cast part, by a removable oil channel core, preferably formed as a core pull void by pulling out of an oil channel core, or the oil channel core is formed with a peg-shaped widening. Preferably a supporting of the oil channel core during coating occurs via the preferably integrally formed peg-shaped widening.

It is particularly preferred to connect the oil channel core at its peg-shaped widening with a crankcase core in an area intended for later surface treatment. With respect to the preferred arrangement or design of this location, to avoid repetition, reference is made to the above-described embodiments. The connecting of the oil channel core with the crankcase core advantageously occurs following the coating and prior to the actual casting process, in order to stabilize the oil channel core during casting. Preferably the oil channel core is adhered to the crankcase mold in the area of the peg-shaped widening, for example by means of adhesive droplets. Although the coating is damaged thereby, this damage does not interfere, since the cast part is surface treated precisely at this location, as has already been described above. The adhering can also be dispensed with. It can also be advantageous to have the crankcase mold exhibit a recess for improved fixation, which serves for receiving the peg-shaped widening of the oil channel core, whereby a precise fitting connection between crankcase mold and oil channel core results. Further, by this means the oil channel core can be stabilized in advantageous manner during casting. Shape locking and adhesive joining can also be combined.

By the resulting opening at the fitting location of the oil channel core/crankcase mold, the cleaning of the residual sand from the long, narrow, curved channels in the cast part is also facilitated.

A surface of the cast part produced at least from the crankcase mold and the oil channel cores can be so processed following casting, that in the area of the peg-shaped widenings an opening results. A processing can in particular be necessary, in order to conform or adapt the raw cast contour. In particular, in the area of the peg-shaped widening a receptacle on the side for a main bearing lid can be produced. Therewith the therefrom resulting opening does not impede the return of lubricant in the oil return channel, for example in that lubricant penetrates through the opening, since it is preferably sealed by a main bearing cover provided in accordance with specifications. The opening can also be provided in another location in the crankcase, for example, with reference to the assembled condition, further downwards or possibly somewhat slanted or diagonal with regard to the longitudinal orientation of the oil return flow channel. A sealing can also be provided by a different bearing cover geometry or by another component. In particular the opening can be sealed by a peg or a cap. In a simple embodiment the opening can be unsealed, if it is provided for example at a location where the return flow of lubricant is not influenced, for example, where the emergence of oil does not disadvantageously impact the lubricant cycle.

In the following the invention will be described in greater detail on the basis of an illustrative embodiment shown in the FIGURE. The FIGURE, the description and the claims contain numerous characteristics in combination, which a person of ordinary skill can consider individually and recombine into other useful combinations.

BRIEF DESCRIPTION OF THE DRAWING

The single FIGURE shows a section through a crankcase housing of an internal combustion engine with at least one main oil channel—not shown in the FIGURE—for supplying the internal combustion engine with lubricant and with a oil return channel 10 for return guidance of the excess lubricant from a—not shown—cylinder head into a receptacle 11 in the form of an oil pan, of which an oil pan flange 24 is shown. Between the cast cylinder base 16 and the cylinder head a separating surface 23 facing towards the cylinder head is provided. The piston housing is produced by casting a metal alloy. Therein the oil return flow channel 10 is shaped by a correspondingly shaped oil channel core 18.

DETAILED DESCRIPTION OF THE INVENTION

The oil channel core 18 is extracted or removed from the cast cylinder base 16 following the casting process and so forms a correspondingly shaped channel, namely the oil return flow channel 10. This has a narrow, elongate cross section and exhibits a peg-shaped widening 12 which is formed by the provision of a bearing support on a correspondingly designed oil channel core 18. The peg-shaped widening 12 is provided in an area 13 destined for later surface treatment, which forms a sideways receptacle surface 14 for a main bearing lid for the main bearing 21 of a crankcase 15. The main bearing cover is secured to the cylinder base 16 via a threaded connection, for which a helical thread 22 is provided.

The peg-shaped widening 12 is formed transverse to the main direction of elongation of the oil return flow channel 10 or, as the case may be, oil channel core 18. It is formed on the oil channel core and forms a bearing support during a thermal treatment, which occurs in particular after a coating of the oil channel core. By this advantageous method of supporting, there is produced no danger that the oil channel core bends or sags or otherwise deforms due to its geometry, which deformation could have a disadvantageous effect for the later formation of the oil return flow channel. It is noted that the surface of the coating becomes damaged in the area on which it is supported. This has however no disadvantageous effect in any later process step in the manufacture of the crankcase, since the peg-shaped widening is provided in an area 13 which later is anyway intended for surface treatment. The surface treatment results in a precision removal of, in particular, the surface of the cast part including the oil channel core 18 and the crankcase core 19, in order to produce for example in the area 13 a sideways receptacle 14 for the intended to be provided main bearing lid. In the FIGURE, the dashed line represents the rough cast geometry 25 following casting. The continuous line shows the contour 26 of the surface of the cast part following surface treatment. Therefrom there results, in the area of the peg-shaped widening 12, an opening 17, which is later sealed by the main bearing lid. Preferably the diameter of the opening is smaller than the height of the lid, in order to achieve an advantageous sealing.

The oil channel core 18 is connected at its peg-shaped widening 12 in the area 13 with the crankcase core 19 after coating, whereby the oil channel core 18 is stabilized during the casting. The joint can be produced using adhesives. The oil channel core 18 can be connected in a precision fit with the crankcase core 19, wherein it is received with its peg-shaped widening 12 in a recess 20 of the crankcase core designed as a recess. Form-fitting and adhesion-joining can be combined.

REFERENCE NUMBER LIST

10. Lubricant return flow channel
11. Reservoir
12. Peg-shaped widening
13. Area
14. Insertion receptacle
15. Crankcase
16. Cylinder base
17. Opening
18. Oil channel core
19. Piston or cylinder core
20. Receptacle
21. Main bearing
22. Helical threading
23. Separating surface
24. Flange
25. Rough casting
26. Processed surface contour

The invention claimed is:

1. A crankcase of an internal combustion engine, with at least one main lubricant channel for supplying the internal combustion engine with lubricant and with at least one lubricant return channel (10) for return flow of excess lubricant to a reservoir (11), wherein the lubricant return channel (10) includes a peg-shaped widening (12), which is formed by a formation of a bearing support of an oil channel core (18), wherein the peg-shaped widening (12) is provided in an area (13) intended for later surface treatment, wherein the peg-shaped widening (12) is provided in the area (13) of a lateral or side insertion surface (14) for a main bearing lid of the crankcase (15), and wherein said crankcase is produced by a method comprising:

forming the lubricant return channel (10) in a cast part by a removable lubricant channel core (18), wherein the lubricant channel core (18) for the lubricant return flow channel (10) is formed with the peg-shaped widening (12) provided in an area (13) intended for later surface treatment, the area (13) forming a lateral or side insertion surface (14) for a main bearing lid for a main bearing (21) of a crankcase (15), wherein the peg-shaped widening (12) supports the oil channel core (18) during coating.

2. The crankcase according to claim 1, wherein the peg-shaped widening (12) is oriented transverse to the main direction of elongation of the oil channel core (18).

3. The crankcase according to claim 1, wherein the oil channel core (18) after coating is connected with a crankcase core (19) at its peg-shaped widening (12) in the area (13) intended for later surface treatment, and wherein the oil channel core (18) is adhered with the crankcase core (19).

4. The crankcase according to claim 3, wherein the oil channel core (18) is precision connected at a corresponding receptacle (20) of the crankcase core (19).

5. The crankcase according to claim 3, wherein a rough casting (25) of the cast part (16) resulting from the oil channel core (18) and the crankcase mold (19) of the cast part (16) is so processed, that in the area of the peg-shaped widening (12) an opening (17) results.

6. The crankcase according to claim 5, wherein the opening (17) is sealed by a pre-specified intended main bearing lid.

7. The crankcase according to claim 6, wherein the opening is sealed by a peg.

8. The crankcase according to claim 1, wherein multiple oil channels are provided connected to each other, wherein each of the oil channels exhibits a peg-shaped widening (12) facing in the same direction.

9. The crankcase according to claim 1, wherein said crankcase further includes at least one of at least one water channel and at least one pressure oil channel having a peg-shaped widening.

10. An oil channel core for producing an oil return channel in a crankcase of claim 1, wherein a peg-shaped widening (12) is provided in an area (13) intended for later surface treatment of a cast part and the peg-shaped widening (12) is provided as bearing support for thermal treatment.

11. The oil channel core according to claim 10, wherein the peg-shaped widening (12) is oriented transverse to the main direction of elongation of the oil channel core (18).

12. The oil channel core according to claim 10, wherein the peg-shaped widening (12) is attached or unitary.

* * * * *